US005678679A

United States Patent [19]

Berman

[11] Patent Number: 5,678,679

[45] Date of Patent: Oct. 21, 1997

[54] UNIVERSAL SLOT MACHINE TABLE

[75] Inventor: Cary B. Berman, Gladwyne, Pa.

[73] Assignee: Holly Products, Inc., Moorestown, N.J.

[21] Appl. No.: 525,202

[22] Filed: Sep. 8, 1995

[51] Int. Cl.[6] ..... G07F 1/04

[52] U.S. Cl. ..... 194/344; 194/350

[58] Field of Search ..... 194/344, 350; 273/143 R; 312/223.6; 232/15, 16

[56] References Cited

U.S. PATENT DOCUMENTS

| | | | |
|---|---|---|---|
| 2,828,909 | 4/1958 | Sollenberger et al. | 194/350 X |
| 4,342,384 | 8/1982 | Fukase et al. | 221/9 |
| 4,998,612 | 3/1991 | Halsey et al. | 194/350 |
| 5,129,501 | 7/1992 | Halsey et al. | 194/350 |
| 5,386,903 | 2/1995 | Rothschild et al. | 194/350 |

FOREIGN PATENT DOCUMENTS

| | | | |
|---|---|---|---|
| 3-21286 | 1/1991 | Japan | 453/56 |

*Primary Examiner*—F. J. Bartuska
*Attorney, Agent, or Firm*—Synnestvedt & Lechner

[57] ABSTRACT

A mounting table for slot machines with a compartmented base and mounting surface cut-outs suitable for positioning four slot machines in a back to back configuration or two slot machines in either an in-line or back to back configuration or a single slot machine. The base is compartmentalized into a lockable hopper fill coin storage compartment for each slot machine and a lockable coin drop compartment that can service all the slot machines mounted on the mounting surface. Funnels are removably mounted to the underside of the mounting surface, beneath the coin drop area of each slot machine, so as to permit removal without moving the slot machines. In the event of coins jamming in the funnels, funnels are removed and serviced from the lockable coin drop compartment. When necessary, funnels are equipped with drop tube extensions that conduct coins to individual coin buckets in the coin drop compartment. Drop tube extensions are either removably or permanently attached to the funnels. The door to the coin drop compartment may be bottom hinged.

14 Claims, 9 Drawing Sheets

UNIVERSAL SLOT MACHINE TABLE

BACKGROUND OF THE INVENTION

1. Field of the Invention

The present invention relates to a storage cabinet base and mounting platform system for up to four casino slot machines. More particularly, this base cabinet and platform system has a coin drop compartment into which coins from up to four slot machines are directed. A hopper fill coin storage compartment is provided for each slot machine. This universal cutout and mounting system directs coins from the coin drop area of commercial slot machines into coin funnels and transport systems that properly route the coins to separately identifiable and lockably accessible coin buckets. The coin transport system is separately serviceable from lockable compartments without moving the slot machines.

2. Description of the Relevant Art

In a casino slot machine room, slot machines are mounted on a knee high counter top in a manner to maximize aisle space and minimize space taken up by the slot machines. The most efficient utilization of space is achieved by placing rows of slot machines in a back to back configuration. The side clearance between machines is sufficiently wide to accommodate a player's coin bucket and slot arm pull.

In a casino slot machine, wagered coins are semi-continually discharged from a coin drop area located in the underside of the slot machine. These coins represent the house gross income. The coins released by the machine to the player, typically at the lower front tray of the slot machine, represent a players' winnings. Coins to supply players' winnings are periodically recharged into the machine by casino personnel. With modern electronic technology, the status of the coins in each machine is communicated, via electrical cabling, to a central control station.

The need to reload hopper fill coins into a particular machine is recognized at the central control station. However, accomplishing the task of moving hopper fill coins to the particular slot machine and recharging the machine is disruptive to casino operations. During peak casino hours traffic problems slow the transfer operation, increase the duration of coin exposure, increase the possibility of theft and pilferage, and cause disruption to the gamblers in the casino. Devices that expedite coin transfer, save slot machine downtime, and provide increased security are eagerly sought by the casinos.

Slot machines are traditionally installed on cabinet type bases and counter tops to form a mounting platform unit. A mounting platform unit can be designed to support one, two, or four slot machines in a wall or island configuration. Typically, multiple bases and counter tops are separately manufactured and subsequently assembled at the installation site. Each slot base cabinet unit is aesthetically customized for installation at the particular customer's location.

Traditional mounting platform units have few individually accessible compartments in the base units. This limits storage for hopper fill coins. Moreover, the under counter coin drop storage area is accessible from only one side, even on mounting platform units designed to accommodate two or four slot machines in a back to back configuration.

Another problem with installing modern slot machines over conventional base-counter top systems is that the weight of modern slot machines inevitably causes the unsupported tops to sag. This problem eventually causes operational difficulties in that the under counter doors bind.

What is needed is a slot machine mounting platform unit with a universal hole pattern that can be manufactured off-site as a single component. Mounting platform units should be capable of accommodating two or four slot machines in either a back to back or in-line configuration. The surface on which the slot machine rests should be rigid and non-deformable by the weight of the slot machines. The bases should house a multiplicity of lockable compartments, preferably one coin storage compartment for each slot machine and a single coin drop compartment that services all slot machines mounted on that particular mounting platform unit. Without modification, the universal top design should accept most commercial types of slot machines. Additionally, coin funnels should be installable and serviceable only from a locked coin drop compartment underneath the mounting top. Ideally, the coins from all machines mounted on the top should be directed into individual coin buckets and all coin buckets should be accessible through a single lockable door.

With the foregoing in mind, it is an object of this invention to provide a universal mounting platform system upon which up to four slot machines, manufactured by a variety of vendors, may be installed without customizing the basic design. Moreover, each slot machine should drop its coins into a separately identifiable coin transport system.

Another object of this invention is to transport dropped coins from the machines to central coin buckets, one bucket servicing each machine, and providing that all buckets are accessible only through a single lockable door.

Yet another object of this invention is to provide separate lockable hopper fill coin storage compartments for each slot machine installed on the platform mounting unit.

Still another object is to provide a rigid slot machine mounting platform that will support up to four slot machines without eventually sagging.

Another object of this invention is to provide a removable coin funnel that, if jammed, may be disassembled and unjammed from the underside of the machine platform without moving the individual slot machines.

Yet another object of this invention is enhance coin security by ensuring that the removable coin funnel may only be removed from the central drop compartment.

Other objects of this invention will become apparent from the following summary and description of the invention.

SUMMARY OF THE INVENTION

This invention satisfies the need in the gaming industry for universal slot machine mounting platforms having lockable doors that access multiple compartments. These universal off-site manufactured platforms have separate lockable hopper fill coin storage compartments for each slot machine. Money from the coin drop area of each slot machine is transported through the platform base area to a coin bucket. One coin bucket services each slot machine and all coin buckets are located in a centrally located easily accessible coin drop compartment having a lockable door. Coin security is enhanced by separating the individual hopper fill coin storage locations from the coin drop compartment.

This invention comprises an integrated base and top surface on which to permanently mount slot machines. Openings are cut into the top surface to route electrical service and control wiring to the slot machine and to route coins from the slot machine's coin drop area into a coin bucket.

The base is compartmentalized into a plurality of lockable compartments. Separate lockable hopper fill coin compartments are provided for each slot machine on the top surface. Coins to resupply the slot machines are stored in these compartments. The hopper fill compartments facilitate coin resupply during peak casino hours. The hopper fill compartments can be serviced during off-peak casino hours thereby increasing security by minimizing public knowledge of the money stored beneath the slot machines and decrease the machine down time. Casino security is also enhanced by ensuring that hopper fill coins for only one slot machine are accessible at a time.

A funnel system underneath the coin drop area of each machine conducts coins from the slot machines to coin buckets located in a coin drop compartment. The funnel system is configured and routed so that coins from all slot machines on the top surface are routed to coin buckets positioned in a single lockable coin drop compartment. This feature decreases the amount of time required to service the coin buckets since multiple coin buckets can be accessed by opening only one door. This feature also minimizes the length of arm reach required to remove a heavily filled coin bucket.

Since space is at a premium in a casino, the slot machines should be as close to each other as practical. Typically, slot machines are separated by the width of a gambler's coin bucket. In order to obtain a sufficient number of hopper fill compartments and a drop compartment within the base volume, some slot machines must be positioned over hopper fill compartments. This creates a problem in that funnels should be accessible and removable from only the coin drop compartment. This problem has been solved by providing funnels with drop tube extensions to divert coins to a practical bucket location. The discharge ends of the drop tube extensions are positioned in the coin drop compartment. Drop tube extensions are permanently attached to the funnel.

The funnels are supported by guide clips secured to the underside of the counter top. Guide clips surround the funnel's flange on all sides and are removable. The removable clips are removable only from the coin drop compartment thus ensuring that the funnel can be removed only from that compartment. When the clip is removed, the funnel, supported by guide clips, slides into the coin drop compartment, and when free of the guide clips can be lowered to facilitate removing jammed coins.

Base compartments typically employ vertically hinged lockable doors. The preferred embodiment features a coin drop compartment having a door that is horizontally hinged at its bottom. This door opens in an outwardly and downwardly fashion. When open, the unhinged side of this door may rest on the floor.

The process of removing coins jammed in the drop tube extension or funnel underneath a slot machine is initiated by opening the door to the coin drop compartment. Opening the door reveals and provides accessibility to the jammed funnel. The jammed funnel is detached from the underside of the counter top. Once detached, the coins in the jammed funnel and drop tube extension are dumped into a container. Finally, the cleared funnel is reattached to the underside of the mounting plate. Optionally, with the drop tube extension attached, it is sometimes possible to insert a rod or bar up into the funnel and break the coin jam.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENT

Figure 1A:
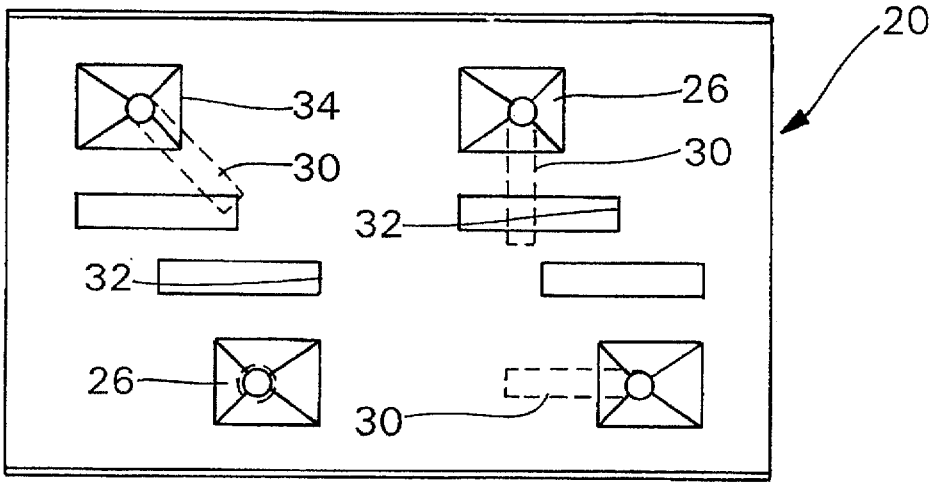
FIG. 1*a* is a top plan view of a counter top configured to support four slot machines, called a quad arrangement.
Figure 1B:
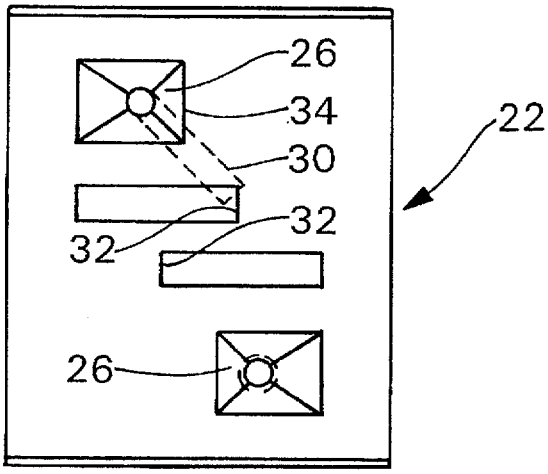
FIG. 1*b* is a top plan view of a counter top configured to support two slot machines in a back to back arrangement.
Figure 1C:
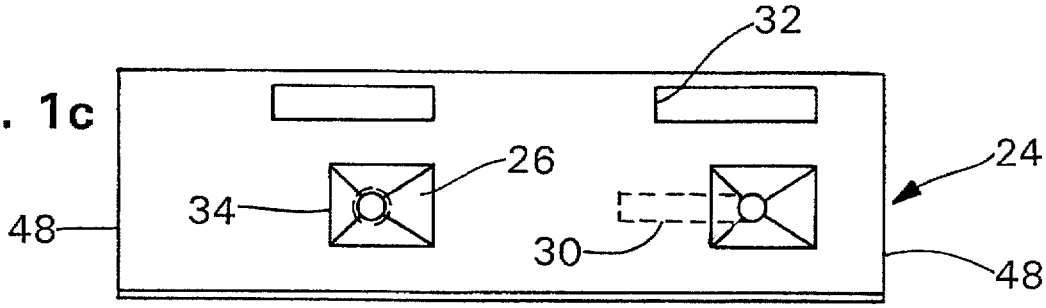
FIG. 1*c* is a top plan view of a counter top configured to support two slot machines in line, called a side to side arrangement.
Figure 1D:
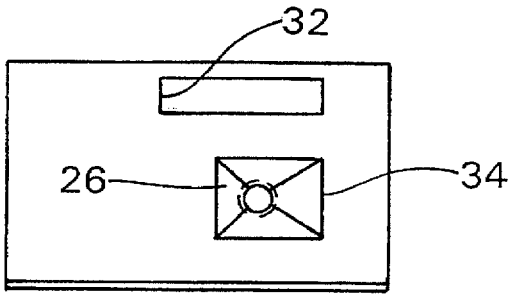
FIG. 1*d* is a top plan view of a counter top configured to support one slot machine.

FIGS. 1*a* through 1*d* show the top surface of several plates or counter tops on which slot machines may be mounted. FIG. 1*a* is the top mounting plate of quad table 20 on which four slot machines may be mounted. FIGS. 1*b* and 1*c*, illustrate mounting plates for back to back table 22 and side to side table 24. Funnels 26 are positioned at each slot machine location and electrical cut-outs 32 are located contiguous to each funnel 26. Funnels 26 and electrical cut-outs 32 are located so that when the slot machine is installed on tables 20,22,24, the funnels and electrical cut-outs are covered by the slot machine bases and are beneath the slot machine coin drop and electrical connector, respectively.

At present twenty-nine models of slot machines from various manufacturers have coin drop areas positioned at different locations in their base. Some coin drop areas are distal to the handle side of the slot machine; others are more nearly centered. As illustrated in FIG. 1*c*, funnel cut-outs 34 and electrical cut-outs 32 are positioned nearer to one end closure panel 48 than to the other end closure panel. This uncentered unsymmetrical positioning provides a universal table that accommodates these twenty-nine slot machines from a large number of manufacturers.

Figure 2:
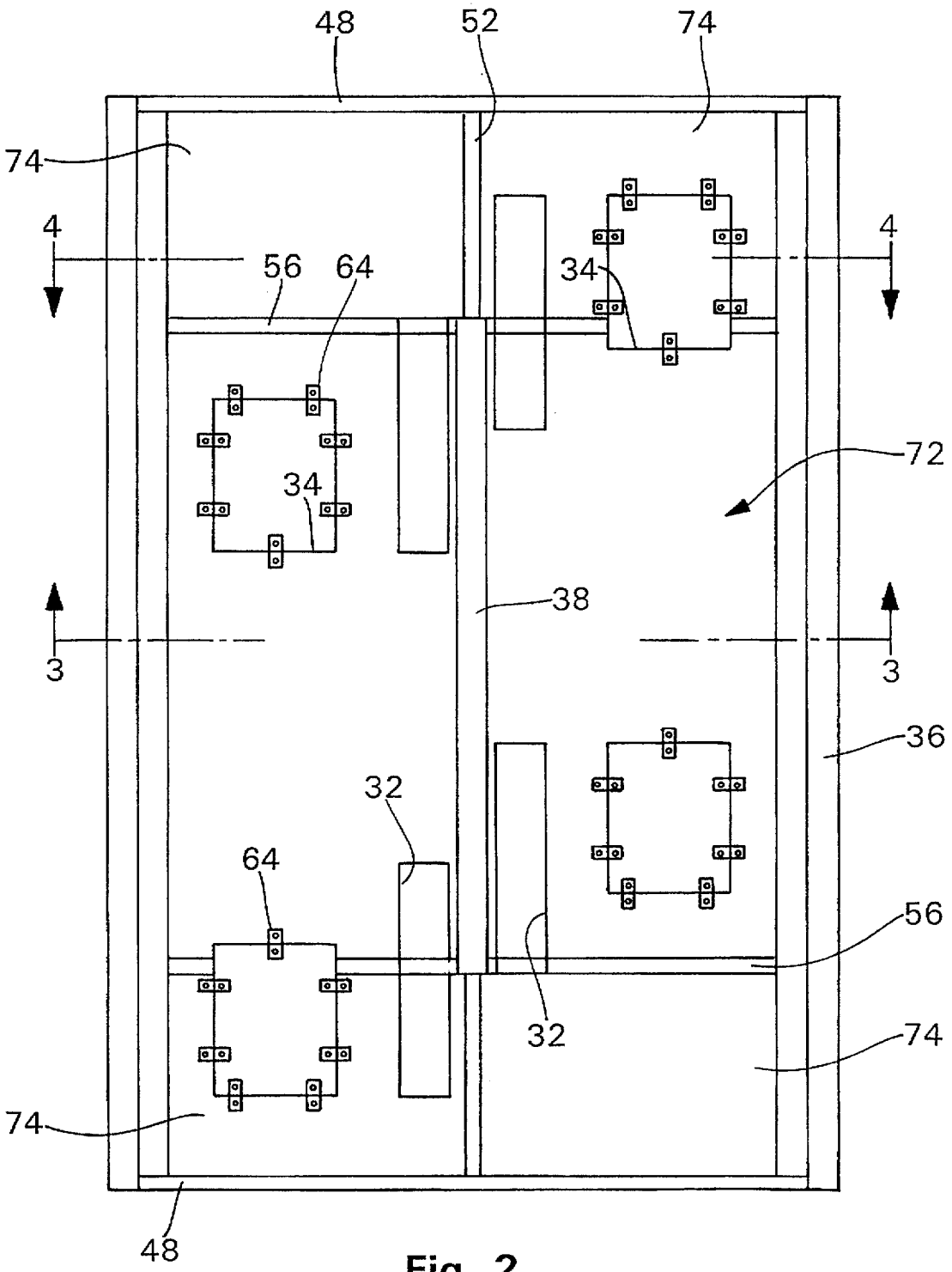
FIG. 2 is a reflected plan section of a quad table taken through the plane and in the direction as shown in FIG. 4, showing the underside of the quad mounting plate of FIG. 1*a;*
Figure 3:
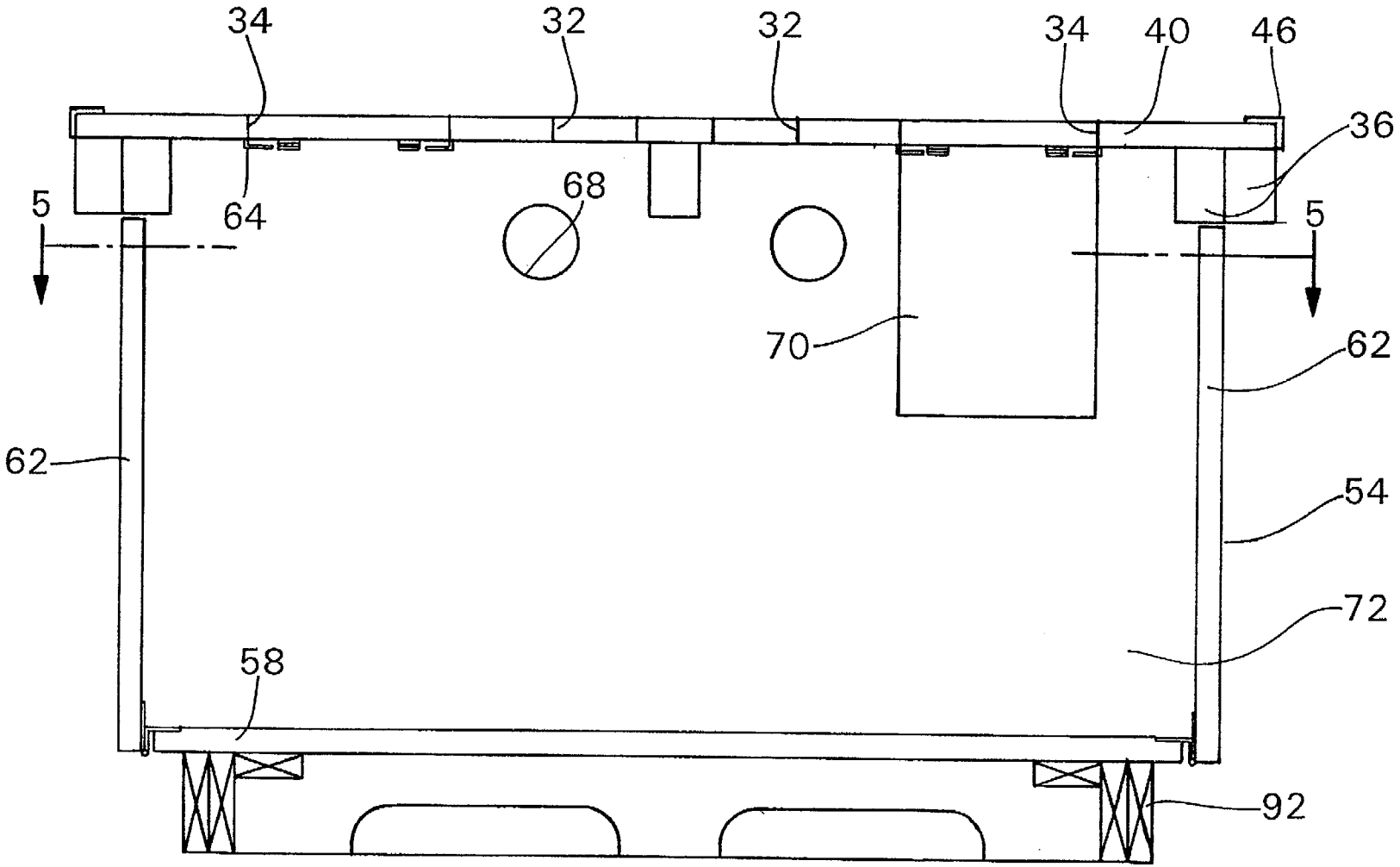
FIG. 3 is a cross section view of a quad table taken through the plane and in the direction as shown on FIG. 2.
Figure 4:
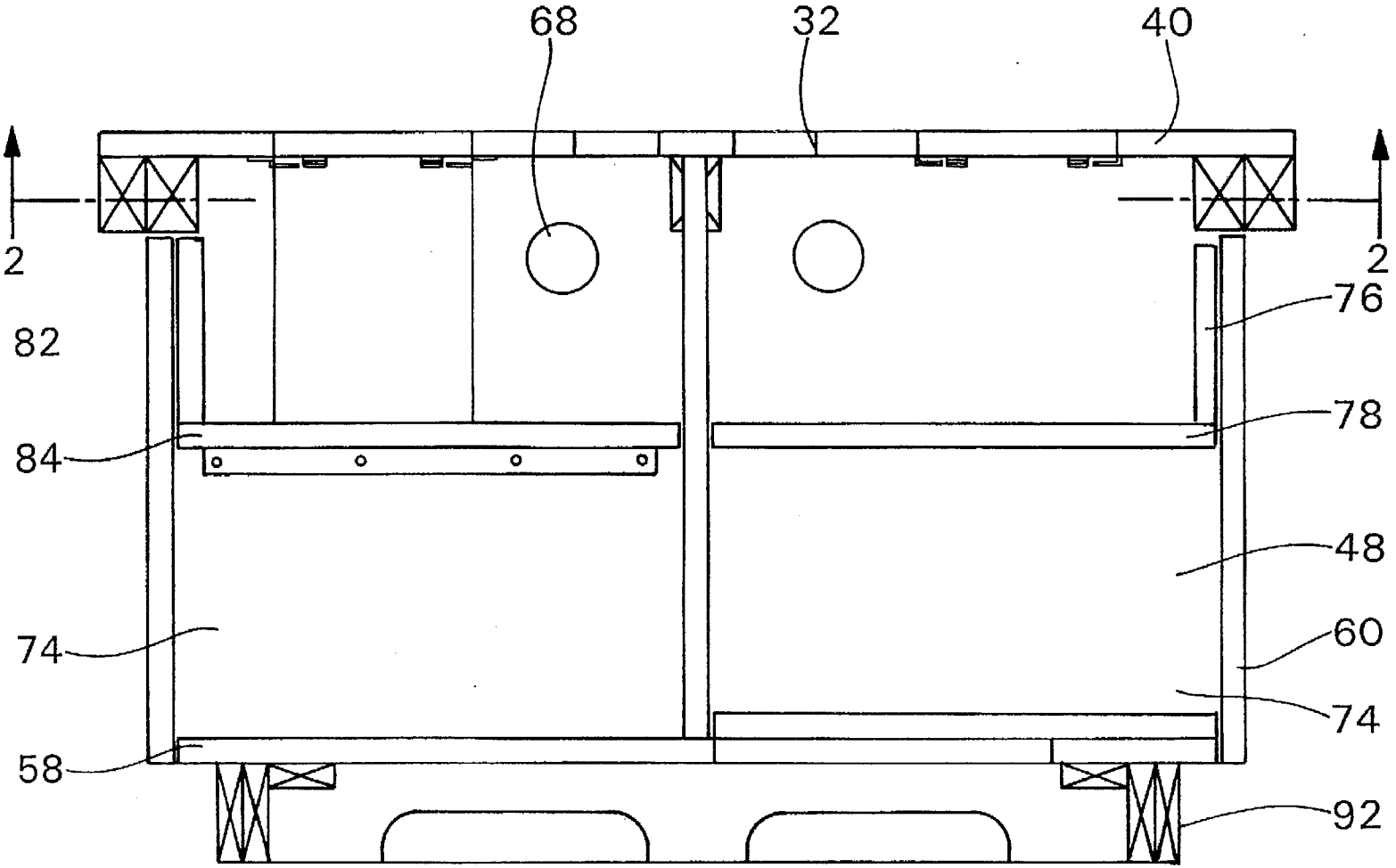
FIG. 4 is a cross section view of a quad table taken through the plane and in the direction as shown on FIG. 2.
Figure 5:
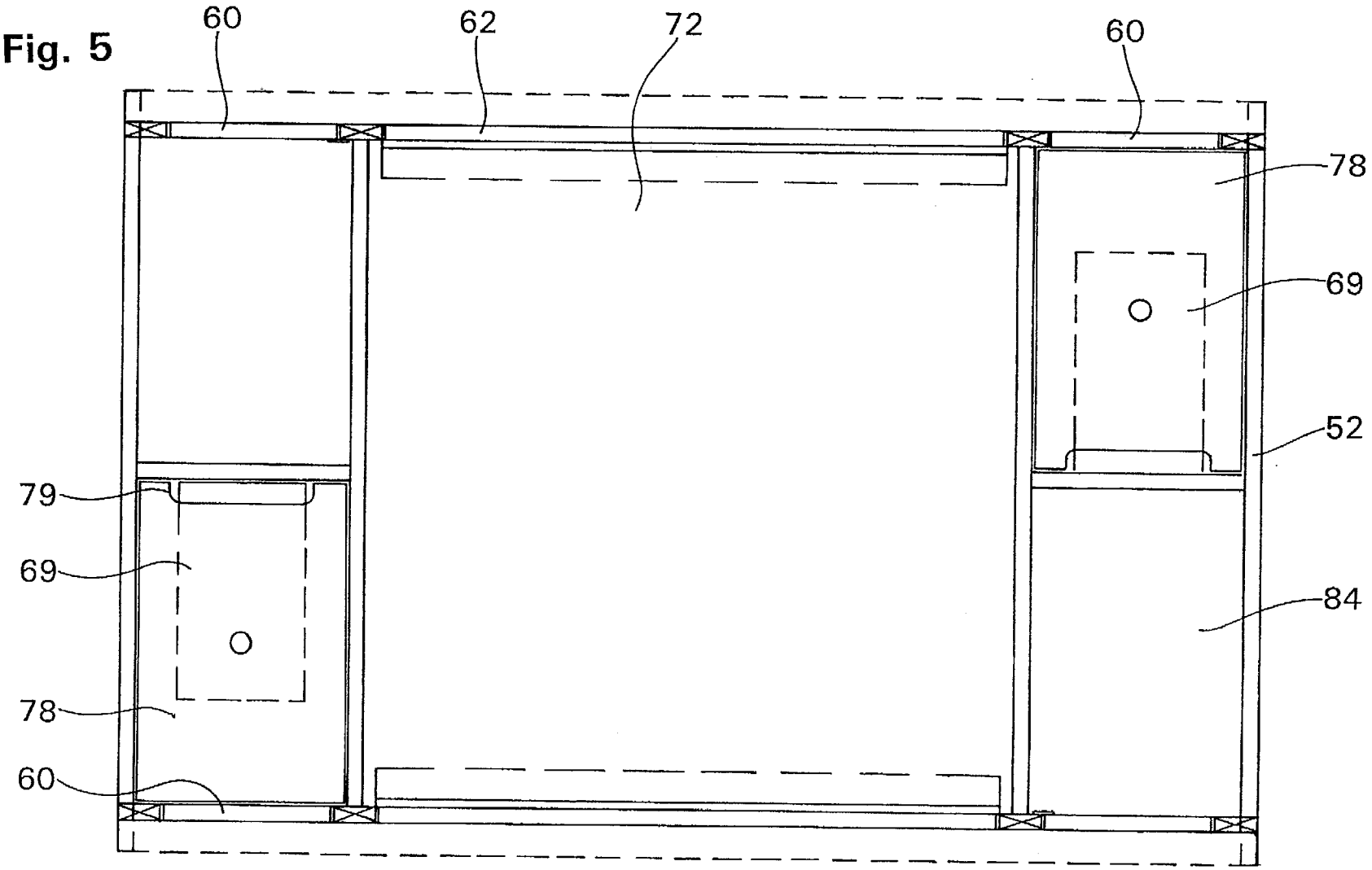
FIG. 5 is a plan section view of a quad table taken through the plane and in the direction as shown on FIG. 3.
Figure 6:
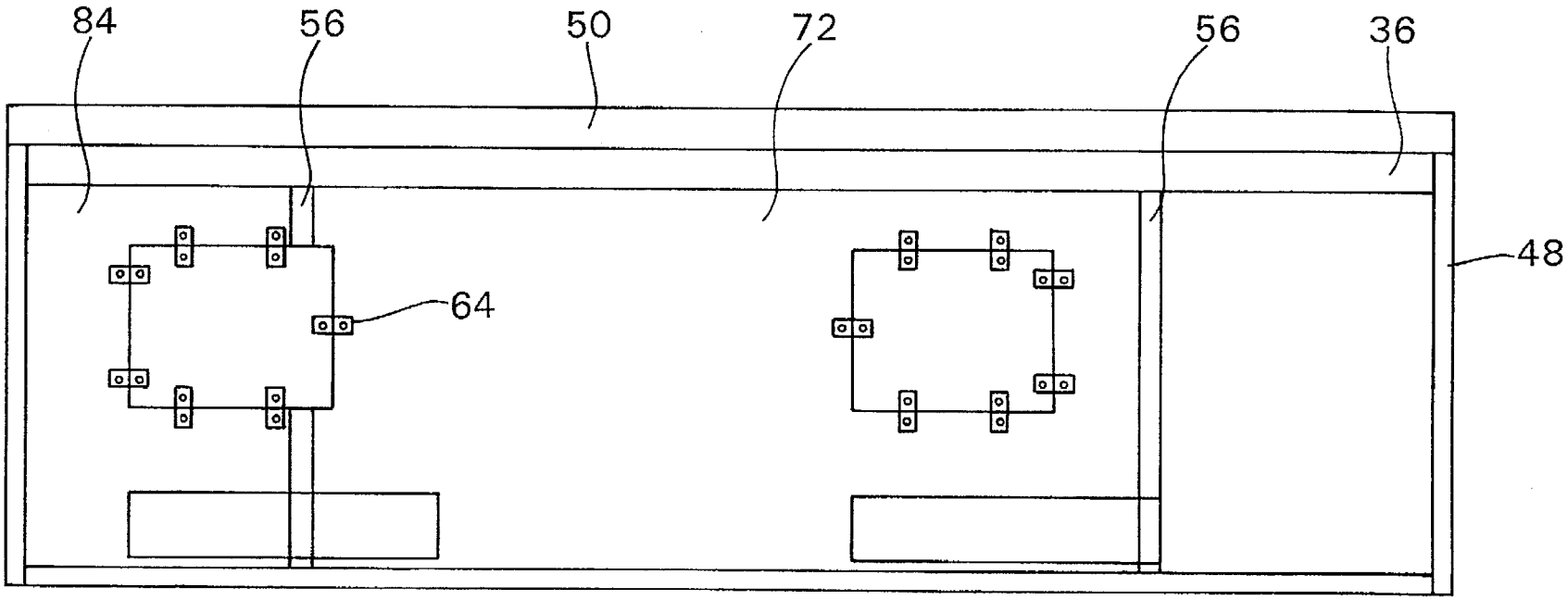
FIG. 6 is a reflected plan section of a side by side table showing the underside of the mounting plate.
Figure 7:
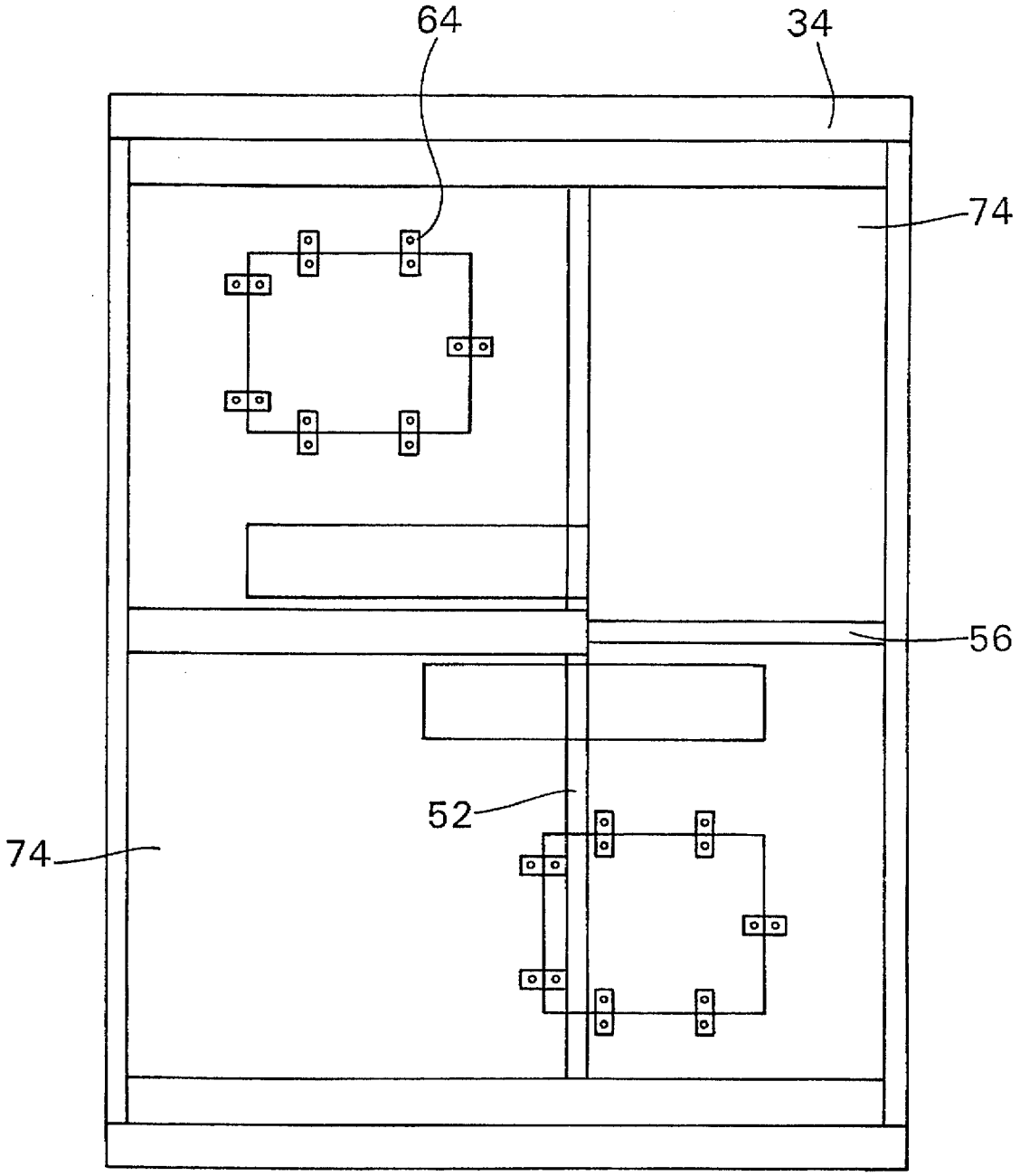
FIG. 7 is a reflected plan section of a back to back table plate showing the underside of the mounting plate.
Figure 8B:
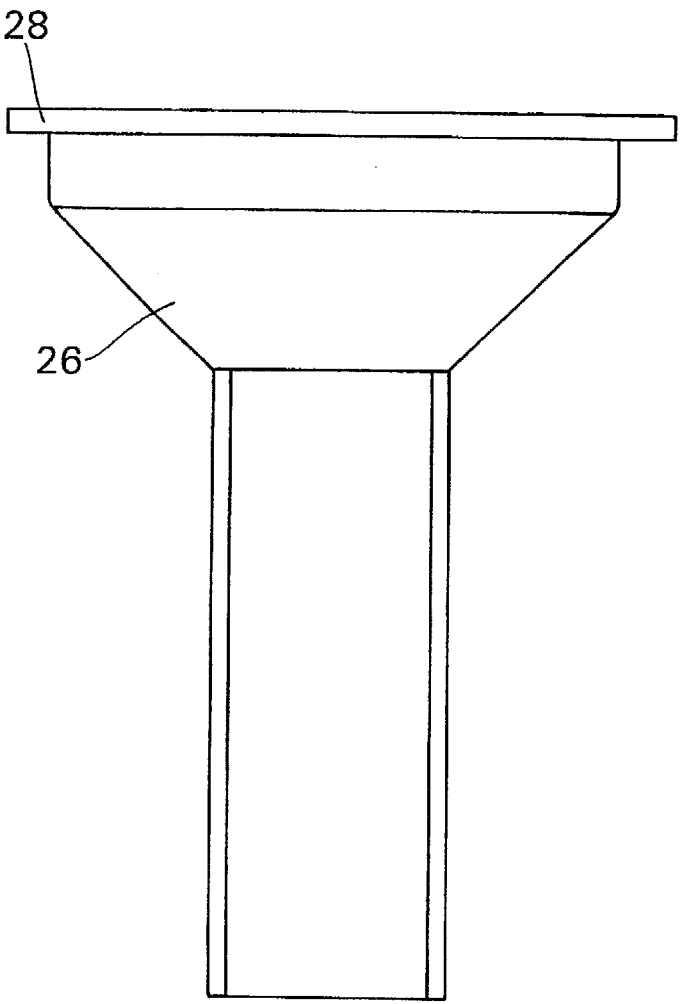
FIGS. 8*a* and 8*b* are partial cross sections of a funnel with detachable drop tube extension.
Figure 8A:
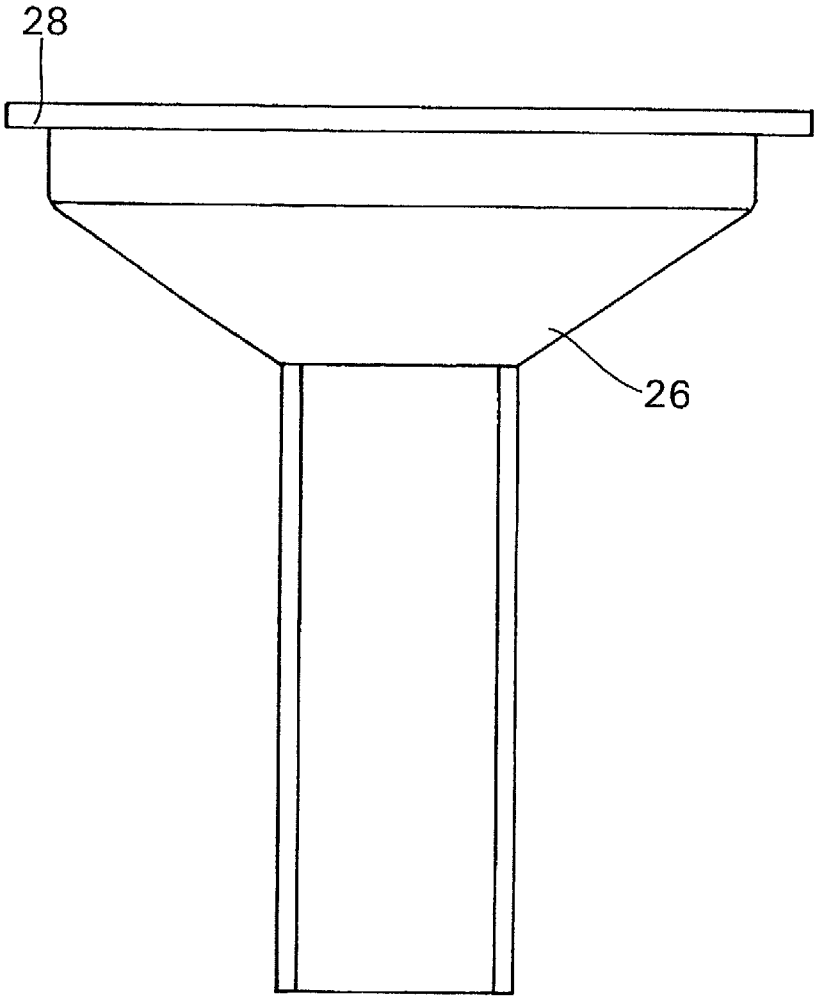

FIGS. 2 through 5 are cross sectional views taken through back to back quad table 20. FIG. 2 and FIG. 5 are horizontal cross sections; FIG. 3 and FIG. 4 are vertical cross sections. Electrical cut-outs 32 extend through the table top or mounting plate 40 and define a passage through which electrical cables may be routed to the slot machines. As better seen in FIG. 8, funnels 26 are mounted below funnel cut-outs 34. Funnels 26 are removably mounted on the underside of mounting plate 40. Mounting plate 40 is desirably constructed of load supporting member and laminate in order to provide a combination of strength and appearance to the mounting surface. Supporting member may be plywood or any other material such as steel, aluminum, composite or honeycomb materials that are sufficiently strong to carry the load of the slot machines without undue deflection. The laminate provides a finished appearance to the surface. Optionally, protective member 46 shown in FIG. 3 may be installed to protect the edges and corners of laminate top. Often protective member 46 is an angle member of anodized aluminum; however, other shapes and materials are suitable.

Advantageously, load supporting member is constructed of plywood to facilitate attachment of clips 64 to top 40. Three clips 64 are affixed on the underside of top 42, providing slidable support for funnel flange 28. Clips 64 may be permanently attached to the underside of top 42 with screws. Fastening means that secure removable clips 64 to top 42 are such as to allow the clip 64 to be quickly and easily removed. Screws or bolt/wing nut combinations securely hold clip 64, are quickly removable and are suitable fastening means. Removable clip 64 may be any removable combination of devices that secures funnel flange 28 and funnel 26 in place. Such a device could be as simple as a screw vertically engaged into load supporting member 40. More desirable, however, is a member that supports or traps flange 28 over more of the length of flange 28 such as the removable clip 64 described above.

When it is desirable to conduct coins laterally from funnel 26, that funnel is equipped with drop tube extension 30, as seen in phantom line in FIGS. 1*a*, 1*b* and 1*c*. Drop tube extension 30 may be permanently mounted to funnel 26 with adhesive or by other suitable means known to a person skilled in the art. Such means include but are not limited to plumbing fittings such as unions and couplings. A system in which the drop tube extension is not detachable from funnel 26 is more secure in that coins coming through the funnel can only be accessed from one compartment.

Base 54 is constructed to provide at least one hopper fill coin compartment for each slot machine and at least coin drop compartment. Moreover, it is desirable to reinforce mounting plate 40 to provide additional structural support. Such reinforcement is provided for by a compartmentalization scheme.

FIG. 2 shows the compartmentalization scheme of quad table 20. Table 20 has end closure panels 48 at either end of the table. End closure panels 48 located between adjacent tables are provided with electrical feed thru's 68 that allow electrical cabling to be routed between adjacent tables. Electrical feed thru's 68 are also provided in interior walls 56. Proper utilization of feed thru's 68 permit one electrical drop to service a group of contiguous slot machines. All slot machines in contiguous cabinets may be accessed electrically through feed thru's 68. All other configurations of slot bases, i.e., back to back, side by side and single, include this feature.

Cabling may be introduced into base 54 through the floor via base apertures 69 that are best seen in FIG. 5. Adjustable shelf 84 is provided with indentation 79 that permits cabling to be vertically pulled through the shelf 84.

Interior wall 56 is provided with cut-out notch 70 so that extensions 30 and funnels 26 that are not positioned over the coin drop compartment may be withdrawn into coin drop compartment 72 without opening the right hand hopper fill coin compartment in which the funnel is actually located.

Quad table 20, having one coin drop compartment, is provided with center cross beam 38 that extends between and is supported by interior wall 56. Center cross beam 38 is installed to provide additional support to mounting plate 40 thus protecting against the undue downward deflection of mounting plate 40 when four slot machines are installed on that mounting plate. Center crossbar 38 may be wood, aluminum, steel, or any material sufficiently strong to protect plate 40 from undue deflection. As better seen in FIG. 2, side crossbars 36, 36 provide strength at the edges of base 54 facing the aisle. Preferably, these crossbars 36, 36 are of hardwood to prevent sagging due to the weight of the slot machines and present a uniform straight edge toward the customer aisle when a series of bases are in line. Base 54 of quad table 20 is also provided with dividers 52 that separate the cabinet into hopper fill coin compartments 74 and a coin drop compartment 72.

Dividers 52 and interior walls 56 extend the full interior height of base 54 and provide support for load supporting member 42. Additional support is provided by center cross beam 38 and double side apron beam 36. The effect is substantial vertical support for load support member 42 thus minimizing any sag when member 42 is bearing the weight of multiple slot machines.

FIG. 4 illustrates how adjustable shelves may be installed in base 54 to provide additional storage. Hopper fill storage compartment 74 on the left side of base 54 in FIG. 4 has no funnel above the compartment, thus permitting sufficient space for adjustable shelf 84 to be installed within the compartment. Adjustable shelf 84 is supported by pins (not shown) inserted in height adjustment holes (not shown).

Adjustable shelf 84 may be positioned so as to allow coin fill bags to be stored on shelf 84 and on bottom 58. On the right side of base 54 in FIG. 4 is installed fixed shelf 78 with vertical security block 76. Security block 76 is permanently installed to fixed shelf 78 so that when door 60 is opened, the funnel is not accessible. Beneath fixed shelf 78 is another coin hopper fill compartment 73.

Figure 9:
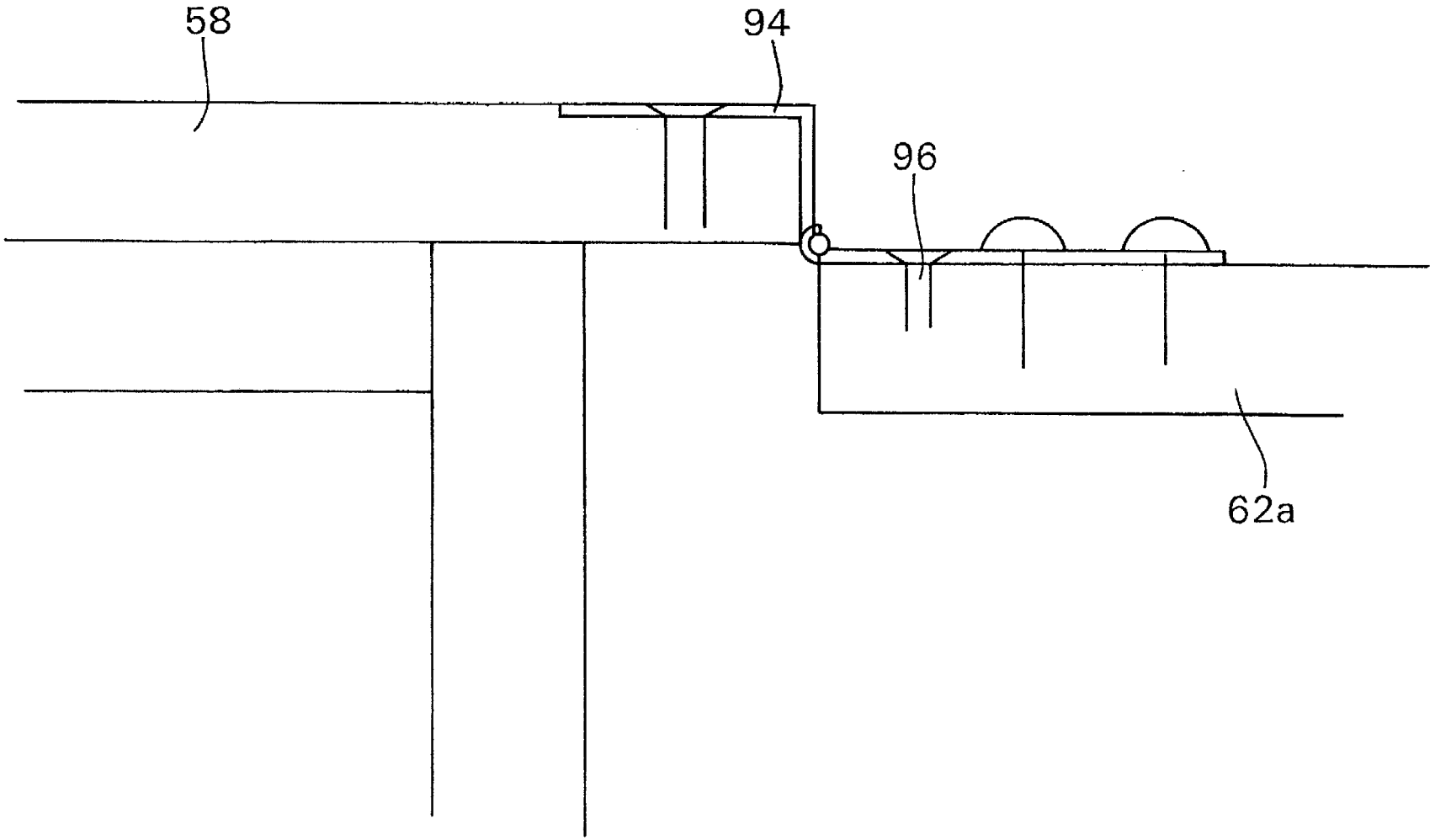
FIG. 9 is a partial cross section of the hinge structure of the can drop compartment door.

A desirable feature of quad table 20 and in-line dual table 22 is that door 62 leading to coin drop compartment 72 is hinged at the bottom. Since table 20, 22 requires that a full length door to coin drop compartment 72 be quite long, two conventional vertically hinged doors would be required with an attendant center stile. Instead, hinging door 62 at the bottom permits a single full length door to be installed. FIG. 9 shows bottom hinged door 62 in open position 53*a*. Door 53 in open position 53*a* supports coin buckets (not shown) as the buckets are transferred from a coin drop compartment 72 to coin truck (not shown).

Door 62 and bottom 58 are preferably mortised to allow hinge 94 to be recessed therein. Hinge 94 is a piano type hinge extending substantially the entire width of door 62. Hinge 94 is secured to bottom 58 and door 62 with two rows of screws 96 in order to provide additional strength to the hinge area. When fully loaded, coin buckets may weigh between eighty and ninety pounds. Recessing the hinge provides coin drop compartment door attachment that, when door 62 is open and substantially horizontal, allows fully loaded coin buckets to be slidably removed without binding on a raised hinge flange.

This apparatus greatly simplifies machine maintenance when coins jam in the funnel or drop tube extension. Instead of lifting and removing the slot machine from the table, a jammed funnel is easily cleared by accessing and removing the funnel from underneath the table. The first step is to unlock the coin drop compartment and open the door to that compartment. Opening the door exposes the members that clamp the funnel. When the retaining clips are removed, the lateral constraint on the funnel is removed and the funnel is withdrawn into the coin drop compartment where the jammed coins may be dumped into a coin bucket thus clearing the funnel. After the funnel is cleared, the funnel flanges are reinserted in the clips, and the funnel pushed back to its home position. Finally, the last clip is reattached and the door closed and locked.

This invention provides an arrangement for mounting slot machines on universal bases that are constructable in a more reproducible factory environment away from the final installation site at the casino. In a factory environment, bases may be constructed to more stringent tolerances. Because the tables are delivered to the job site ready to have slot machines mounted on them, work at the installation site is considerably accelerated. The funnels in these tables are removable from the coin drop compartment underneath the mounting surface permitting the funnels to be cleared without the attendant problems and difficulties of moving a slot machine in a crowded casino.

Although the invention has been described in considerable detail with reference to the preferred embodiment and other illustrative embodiments, the claims are not limited to these embodiments, but rather are directed to all modifications and variations that are within the spirit and scope of this invention and that may be conceived and reduced to practice by those skilled in the art.

What is claimed is:

1. A mounting platform for supporting slot machines with coin drop areas which comprises:

(a) a base, having a front and a top;

(b) a mounting plate affixed to the top of said base and having a plurality of mounting positions, said mounting plate having an underside, and further having funnel cut-outs at said mounting positions;

(c) a plurality of funnels detachably mounted to said mounting plate at said funnel cut-outs, so that coins dropping from said coin drop areas of said slot machines are accumulated and conveyed through said funnels, the funnels being removable from the underside of said mounting plate.

2. The mounting platform of claim 1 wherein the base is partitioned into at least one hopper fill coin storage compartment and at least one coin drop compartment.

3. The mounting platform of claim 2 further comprising a drop tube extension having a discharge end, said drop tube extension being attached to one of said funnels.

4. The mounting platform of claim 3 wherein the discharge end of said drop tube extension is positioned in a coin drop compartment.

5. The mounting platform of claim 1 additionally comprising an electrical cut-out in said mounting plate proximate to each of said mounting positions.

6. The mounting platform of claim 5 further comprising a door attached to said base, said door positioned to access the money drop compartment, said door having a top, a bottom hinge, and an open position, so that the top of said door moves in an outwardly and downwardly fashion to an open position.

7. The mounting platform of claim 6 wherein the open position of said door is substantially horizontal.

8. A method for removing jammed coins from under a slot machine comprising:

(a) opening a door in the base of a slot machine mounting platform to reveal a funnel having a drop tube extension connected thereto, said funnel being detachably mounted to the mounting plate;

(b) accessing the funnel from the opened door within said base;

(c) dumping the coins from the drop tube extension and funnel into a container to clear the funnel and drop tube extension; and (d) closing said open door.

9. The method of claim 8 wherein said drop tube extension remains connected to the funnel while the funnel is detached from the mounting plate.

10. A mounting platform for locating and anchoring a plurality of slot machines having coin drop areas comprising:

(a) a base having a top, a front, a lockable coin drop compartment, and a plurality of lockable coin hopper fill compartments;

(b) a mounting plate attached to the top of said base, said mounting plate having an underside;

(c) a plurality of funnel cut-outs in said supporting plate, said funnel cut-outs positioned under the coin drop areas of said slot machines; and (d) a plurality of funnels, said funnels having a discharge end and being detachably mounted to said supporting plate so that said funnels are removable from the underside of said mounting plate.

11. The mounting platform of claim 10 further comprising a drop tube extension, said drop tube extension having a feed end and a discharge end, said feed end being connected to the discharge end of one of said funnels.

12. The mounting platform of claim 10 wherein at least one of the funnels has an extended discharge end.

13. The mounting platform of claim 11 wherein said discharge ends of said funnels and said discharge end of said drop tube extension terminate in said coin drop compartment.

14. The mounting platform of claim 13 further comprising a plurality of electrical cut-outs in said supporting plate, each electrical cut-out being proximate to a funnel cut-out.

* * * * *